US008852016B2

(12) United States Patent
Kamino et al.

(10) Patent No.: US 8,852,016 B2
(45) Date of Patent: Oct. 7, 2014

(54) GOLF SWING ANALYSIS APPARATUS

(75) Inventors: Kazuya Kamino, Kobe (JP); Keiji Moriyama, Kobe (JP)

(73) Assignee: SRI Sports Limited, Kobe (JP)

( * ) Notice: Subject to any disclaimer, the term of this patent is extended or adjusted under 35 U.S.C. 154(b) by 470 days.

(21) Appl. No.: 13/271,429

(22) Filed: Oct. 12, 2011

(65) Prior Publication Data

US 2012/0108354 A1 May 3, 2012

(30) Foreign Application Priority Data

Nov. 1, 2010 (JP) ..... 2010-244957

(51) Int. Cl.

| | |
|---|---|
| ***A63B 69/36*** | (2006.01) |
| ***A63B 24/00*** | (2006.01) |
| ***A63B 59/00*** | (2006.01) |
| ***A63B 53/00*** | (2006.01) |

(52) U.S. Cl.

CPC ..... *A63B 24/0021* (2013.01); *A63B 2220/35* (2013.01); *A63B 2024/0031* (2013.01); *A63B 69/3658* (2013.01); *A63B 59/0074* (2013.01); *A63B 2220/805* (2013.01); *A63B 69/3614* (2013.01); *A63B 53/00* (2013.01); *A63B 2220/807* (2013.01); *A63B 2220/30* (2013.01); *A63B 2220/16* (2013.01); *A63B 2220/24* (2013.01); *A63B 2220/806* (2013.01); *A63B 69/3623* (2013.01); *A63B 24/0003* (2013.01); *A63B 2220/05* (2013.01)

USPC ..... 473/221; 473/152; 473/155; 473/219; 473/257

(58) Field of Classification Search

CPC ..... A63B 2071/0647; A63B 2024/0009; A63B 2024/0068; A63B 2024/0028; A63B 2024/0056; A63B 69/3632; A63B 2069/3605; A63B 69/3614

USPC ..... 473/219, 221, 257, 152, 155; 382/107, 382/291

See application file for complete search history.

(56) References Cited

U.S. PATENT DOCUMENTS

| | | | | |
|---|---|---|---|---|
| 5,474,298 | A * | 12/1995 | Lindsay | 473/222 |
| 5,638,300 | A * | 6/1997 | Johnson | 702/153 |
| 6,042,483 | A * | 3/2000 | Katayama | 473/199 |
| 7,166,035 | B2 * | 1/2007 | Voges et al. | 473/222 |
| 7,744,480 | B2 * | 6/2010 | Gobush | 473/219 |

(Continued)

FOREIGN PATENT DOCUMENTS

| | | | |
|---|---|---|---|
| JP | 03-210283 | A | 9/1991 |
| JP | 2000-66315 | A | 3/2000 |

(Continued)

*Primary Examiner* — Michael Cuff

(74) *Attorney, Agent, or Firm* — Birch, Stewart, Kolasch & Birch, LLP

(57) ABSTRACT

A swing analysis apparatus 10 for a golf club includes a club camera 20 continuously photographing a behavior of a golf club 34, a ball camera 22 continuously photographing a behavior of a golf ball 36, and an information processor 32. The club camera 20 is positioned in front of a golf player. A straight line C passes through a center of a lens of the club camera 22 and a center of the golf ball 36. An angle θc between the straight line C and a vertical line Z is 10 degrees or greater and 20 degrees or less. The information processor 32 measures a synchronized club behavior value from synchronized club image data. The information processor 32 measures a synchronized ball behavior value from synchronized ball image data. The information processor 32 stores the synchronized club behavior value and the synchronized ball behavior value.

14 Claims, 6 Drawing Sheets

(56) References Cited

U.S. PATENT DOCUMENTS

| | | | | |
|---|---|---|---|---|
| 7,887,440 | B2 * | 2/2011 | Wright et al. | 473/409 |
| 2002/0098897 | A1 | 7/2002 | Manwaring | |
| 2002/0098898 | A1 | 7/2002 | Manwaring | |
| 2002/0155896 | A1 | 10/2002 | Gobush et al. | |
| 2002/0173367 | A1 | 11/2002 | Gobush et al. | |
| 2003/0008731 | A1 * | 1/2003 | Anderson et al. | 473/407 |
| 2005/0261071 | A1 * | 11/2005 | Cameron | 473/219 |
| 2005/0272516 | A1 * | 12/2005 | Gobush | 473/200 |
| 2008/0220891 | A1 * | 9/2008 | Gobush et al. | 473/221 |
| 2011/0028247 | A1 * | 2/2011 | Ligotti et al. | 473/407 |
| 2011/0028248 | A1 * | 2/2011 | Ueda | 473/409 |

FOREIGN PATENT DOCUMENTS

| | | | |
|---|---|---|---|
| JP | 2004-24488 | A | 1/2004 |
| JP | 2007-244716 | A | 9/2007 |
| JP | 2008-104712 | A | 5/2008 |
| JP | 2010-042086 | A | 2/2010 |
| JP | 2010-155074 | A | 7/2010 |

* cited by examiner

GOLF SWING ANALYSIS APPARATUS

The present application claims priority on Patent Application No. 2019-244957 filed in JAPAN on Nov. 1, 2010, the entire contents of which are hereby incorporated by reference.

BACKGROUND OF THE INVENTION

1. Field of the Invention

The present invention relates to an apparatus analyzing a golf player's swing.

2. Description of the Related Art

Analysis of a swing is useful for checking golf player's swing and selecting a golf club fitted to the golf player. For this reason, a swing analysis apparatus is used in a golf club store or the like. Conventional art documents disclose various swing analysis apparatuses. Japanese Patent Application Laid-Open No. 2000-66315 discloses an analysis apparatus photographing a club head and measuring a behavior thereof. US 2002/98898 A1 (Japanese Patent Application Laid-Open No. 2002-248189) discloses an analysis apparatus simultaneously measuring both a golf club and a golf ball. US 2002/155896 A1 (Japanese Patent Application Laid-Open No. 2002-306659) discloses an analysis apparatus considering both measurement accuracy and portability. Japanese Patent Application Laid-Open No. 2004-24488 discloses an analysis apparatus detecting a state of a club head at the time of an impact. Japanese Patent Application Laid-Open No. 2008-104712 discloses an analysis apparatus detecting a behavior of a golf club to evaluate an opening of a face surface.

A behavior value of a golf ball is not measured in Japanese Patent Application Laid-Open No. 2000-66315. The corresponding relationship between the behavior of the golf club and the behavior of the golf ball cannot be grasped. Since a club behavior and a ball behavior are measured in one image plane area in US 2002/98898 A1, position accuracy is apt to be coarse. Although the analysis apparatus of US 2002/155896 A1 has excellent measurement accuracy, the apparatus is large-sized, and requires a long measurement time. The analysis apparatus of Japanese Patent Application Laid-Open No. 2004-24488 requires a certain amount of time for measurement and analysis thereof since a large number of marks are provided on a face surface of the golf club. Since the face angle is not measured based on image data in Japanese Patent Application Laid-Open No. 2008-104712, it is difficult to accurately measure the face angle.

As described above, the analysis apparatus which has a simple constitution and is easy to carry about has poor measurement accuracy. On the other hand, the analysis apparatus having excellent measurement accuracy is large-sized, hard to carry about, and requires a long time for measurement.

It is an object of the present invention to provide a swing analysis apparatus for a golf club having a simple constitution and enabling accurate measurement.

SUMMARY OF THE INVENTION

A swing analysis apparatus for a golf club according to the present invention includes a club camera continuously photographing a behavior of a golf club, a ball camera continuously photographing a behavior of a golf ball, and an information processor. The club camera is positioned in front of a golf player swinging the golf club. A straight line C passes through a center of a lens of the club camera and a center of the golf ball. An angle θc between the straight line C and a vertical line Z passing through a center of the golf ball is 10 degrees or greater and 20 degrees or less. Two or more club image data continuously photographed by the club camera are synchronized. Two or more ball image data continuously photographed by the ball camera are synchronized. The information processor measures a synchronized club behavior value from the synchronized club image data. The information processor measures a synchronized ball behavior value from the synchronized ball image data.

Preferably, the analysis apparatus further includes a sensor detecting the golf club existing at a predetermined position during a downswing. Photographing start times of the club camera and ball camera are determined based on a detection signal of the golf club output by the sensor.

Preferably, in the analysis apparatus, the club camera is disposed at a position where a height from a ground level is equal to or greater than 1 m.

Preferably, in the analysis apparatus, the club behavior value is a value of a face angle, a value of a head orbital angle, and a value of a lateral hitting point.

Preferably, in the analysis apparatus, the ball behavior value is a value of a ball speed, a value of a launch angle, a value of a deflection angle, a value of backspin, and a value of sidespin.

Preferably, in the analysis apparatus, the sensor includes a first sensor and a second sensor. P head speed of the golf club is measured based on a detection signal of the golf club output by the first sensor and a detection signal of the golf club output by the second sensor.

Preferably, the analysis apparatus further includes an elongated mark. The elongated mark is stuck on a crown of the golf club. Positions of both ends of the elongated mark are measured to measure the club behavior value.

Preferably, in the analysis apparatus, a plurality of marks is put on the golf ball. Positions of two marks of the plurality of marks are measured to measure the ball behavior value.

Preferably, in the analysis apparatus, the club camera continuously photographs the golf club during a swing to obtain first club image data and second club image data. A club behavior value immediately before hitting is calculated from a first club behavior value measured from the first club image data and a second club behavior value measured from the second club image data.

A golf club fitting apparatus according to the present invention includes a club camera continuously photographing a behavior of a golf club, a ball camera continuously photographing a behavior of a golf ball, and an information processor. The club camera is positioned in front of a golf player swinging the golf club. A straight line C passes through a center of a lens of the club camera and a center of the golf ball. An angle θc between the straight line C and a vertical line Z passing through the center of the golf ball is 10 degrees or greater and 20 degrees or less. Two or more club image data continuously photographed by the club camera are synchronized. Two or more ball image data continuously photographed by the ball camera are synchronized. The information processor measures a synchronized club behavior value from the synchronized club image data. The information processor measures a synchronized ball behavior value from the synchronized ball image data. The information processor stores the synchronized club behavior value and the synchronized ball behavior value. The information processor determines a fitting golf club from a plurality of candidate golf clubs based on the club behavior value and the ball behavior value.

Preferably, in the fitting apparatus, the club behavior value is a face angle.

Although the swing analysis apparatus for a golf club according to the present invention has a simple constitution, the swing analysis apparatus can accurately measure the swing. The club behavior value is synchronized and the ball behavior value is synchronized. Accordingly, the behavior of the club and the behavior of the ball can be accurately grasped. The golf club fitting apparatus according to the present invention has the same effects as those of the swing analysis apparatus. Furthermore, since the golf club fitting apparatus can grasp the behavior of the club and the behavior of the ball corresponding to the behavior of the club, the golf club fitting apparatus enables fitting suitable for improvement of a flight distance and flight direction of the ball.

DESCRIPTION OF THE PREFERRED EMBODIMENTS

Hereinafter, the present invention will be described in detail based on preferred embodiments with appropriate references to the drawings.

Figure 1:
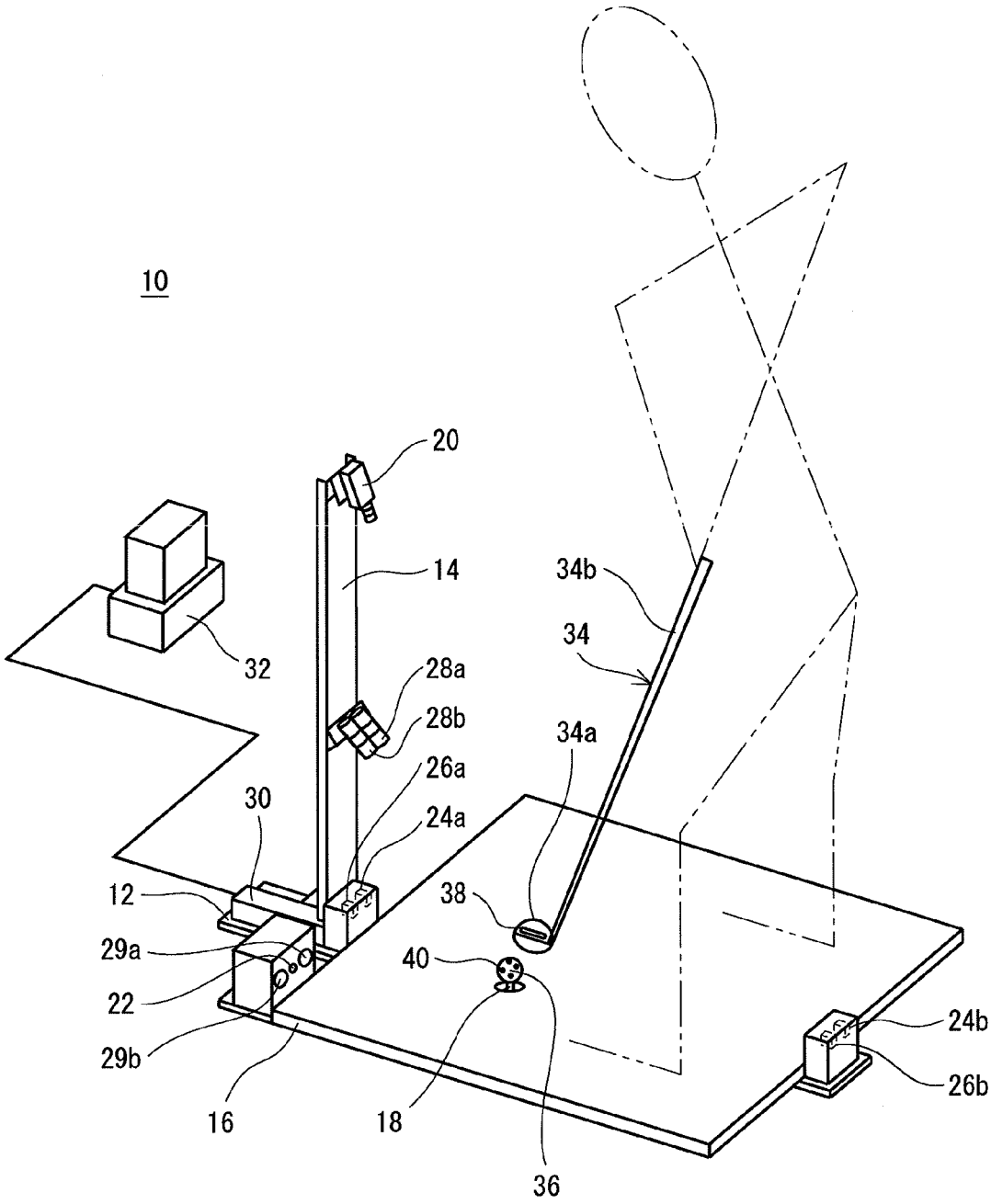
FIG. 1 illustrates a swing analysis apparatus for a golf club.

An analysis apparatus 10 shown in FIG. 1 includes a base 12, a support rod 14, a base plate 16, a tee 18, a club camera 20, a ball camera 22, a first sensor 24 (24*a*, 24*b*), a second sensor 26 (26*a*, 26*b*), a strobe light 28 (28*a*, 28*b*), a strobe light 29 (29*a*, 29*b*), a controller 30, and an information processor 32.

A golf club 34 including a head 34*a* and a shaft 34*b*, and a golf ball 36 are shown with the analysis apparatus 10 in FIG. 1. A right-handed golf player's address posture is shown by a two-dot chain line in FIG. 1. The golf ball 36 is launched toward the left direction of the golf player having the address posture. Herein, to facilitate the description, unless particularly described, a description will be given with a lateral direction of the golf player having the address posture defined as a front-back direction and a front-back direction of the golf player defined as a lateral direction.

The support rod 14 and the base plate 16 are positioned and fixed to the base 12. The support rod 14 extends upward from the base 12. The tee 18 is positioned and mounted to the base plate 16. The club camera 20 is positioned and mounted to an upper part of the support rod 14. The ball camera 22 is positioned on a side surface of the base plate 16 in front of the tee 18. The ball camera 22 is positioned and fixed to the base 12 or the base plate 16. The club camera 20 and the ball camera 22, which are directed toward the golf ball 36, are disposed so that the club camera 20 and the ball camera 22 enable photographing.

The first sensor 24 includes a light emitter 24*a* and a light receiver 24*b*. The light emitter 24*a* is disposed on one side surface of the base plate 16. The light receiver 24*b* is disposed on the other side surface of the base plate 16 with the base plate 16 interposed between the light emitter 24*a* and the light receiver 24*b*. The light receiver 24*b* is disposed in the back of a golf player's feet. The second sensor 26 includes a light emitter 26*a* and a light receiver 26*b*. The light emitter 26*a* is disposed on one side surface of the base plate 16. The light receiver 26*b* is disposed on the other side surface of the base plate 16. The light receiver 26*b* is disposed in the back of the golf player's feet. The first sensor 24 is disposed at a position where the head 34*a* or shaft 34*b* of the golf club 34 to be down-swung crosses between the light emitter 24*a* and the light receiver 24*b*. The second sensor 26 is disposed at a position where the head 34*a* or the shaft 34*b* crosses between the light emitter 26*a* and the light receiver 26*b*. The first sensor 24 and the second sensor 26 are separated by a predetermined distance from the tee 18 in the back of the tee 18 (the right side of the golf player of FIG. 1), and are positioned.

The strobe light 28 (28*a*, 28*b*) is mounted to a center part in the vertical direction of the support rod 14. The strobe light 28 is disposed below the club camera 20. The controller 30 is mounted to the base 12.

Figure 2:
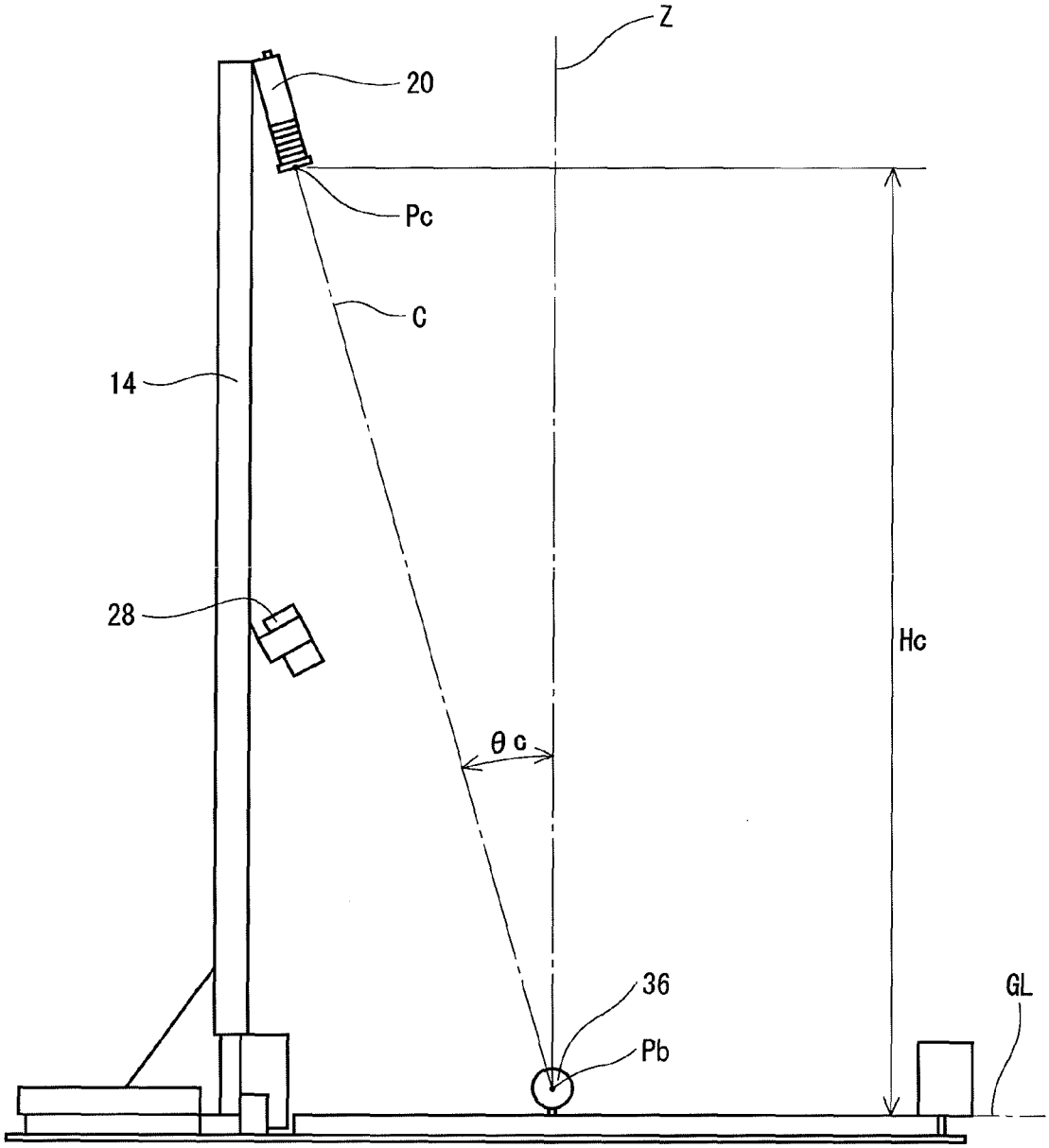
FIG. 2 is a front view of the analysis apparatus of FIG. 1.

A point Pb shown in FIG. 2 shows a central point of the ball 36. A point Pc shows a central point of a lens of the club camera 20. A one-dotted chain line GL shows a ground level on which the golf player stands. A one-dotted chain line Z shows a perpendicular line passing through the center point Pb, in a vertical direction. A one-dotted chain line C shows a straight line passing through the center point Pb and the center point Pc. An angle θc shows a crossing angle between the perpendicular line Z and the straight line C. A double-headed arrow Hc shows a height between the ground level and the center point Pc. In the analysis apparatus 10, for example, the height Hc is set to 1.1 m, and the angle θc is set to 15 degrees. For example, the club camera 20 is disposed so that the center point Pc is positioned at a position separated by 8 cm from the center point Pb in the back in the front-back direction (the right direction in the golf player's lateral direction).

The controller 30 of FIG. 1 is connected to the club camera 20, the ball camera 22, the first sensor 24, the second sensor 26, the strobe light 28, the strobe light 29, and the information processor 32. The controller 30 can transmit a photographing start signal to the club camera 20 and the ball camera 22. The controller 30 can receive an image signal photographed from the club camera 20 and the ball camera 22. The controller 30 can receive a detection signal of the head 34*a* or shaft 34*b* from the sensors 24 and 26. The controller 30 can transmit a light emitting start signal to the strobe lights 28 and 29.

Although not shown in the drawings, the information processor 32 includes a monitor as an output part, an interface board as a data input part, a memory, a CPU, and a hard disk. The information processor 32 may include a keyboard and a mouse. A general-purpose computer may be used as it is as the information processor 32.

The hard disk stores programs. The memory, which is rewritable, includes a storing area and a working area for programs and various data called from the hard disk. The CPU can read the programs stored in the hard disk. The CPU can expand the programs in the working area of the memory. The CPU can execute various processes according to the programs.

Club image data, ball image data, and synchronous data of the two image data can be input into the interface board. These input data are output to the CPU. The CPU executes various processes, and outputs predetermined data of a club behavior value, a ball behavior value, and a calculated value calculated from these behavior values to the monitor. The predetermined data is stored in the hard disk.

Figure 3:
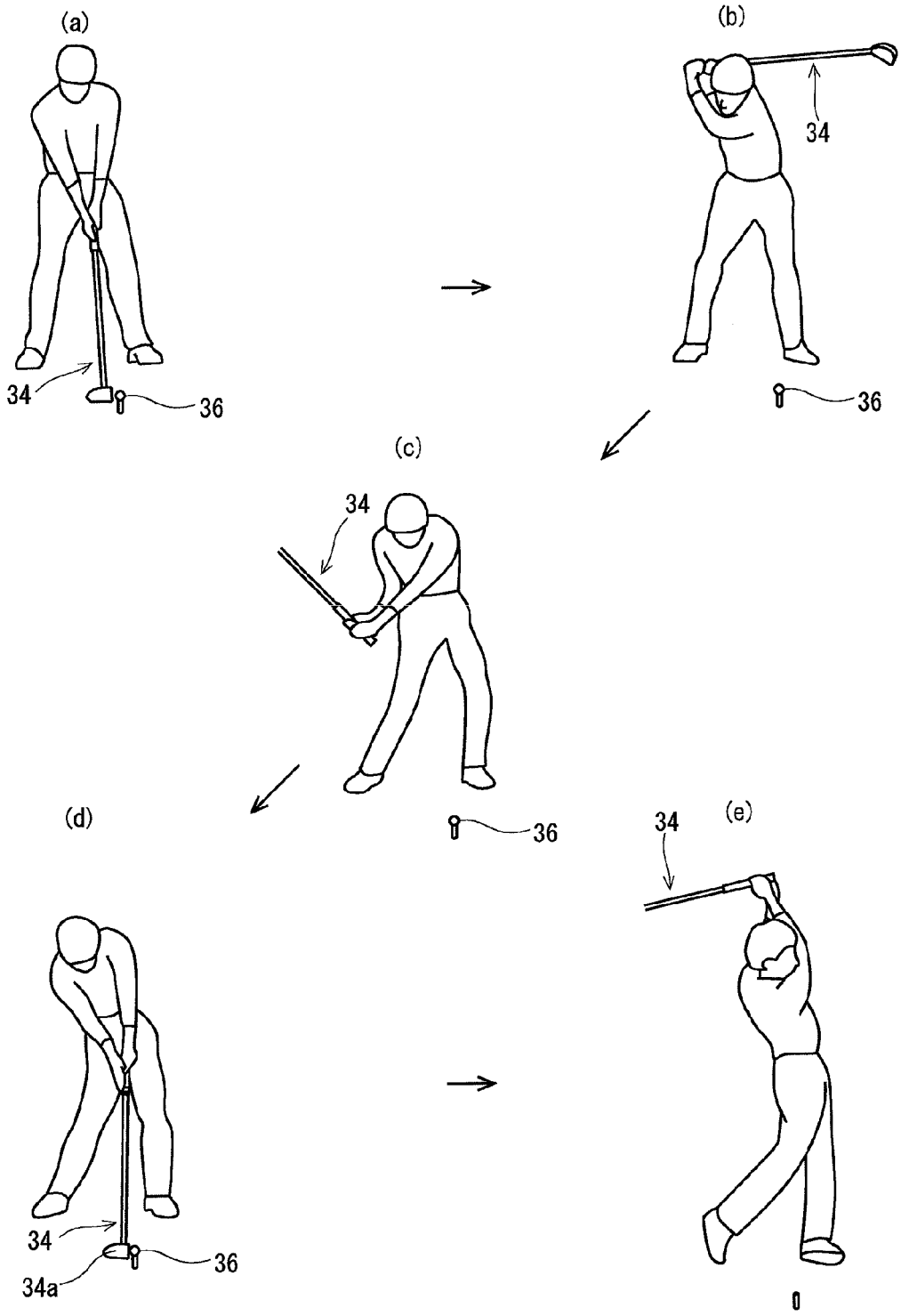
FIG. 3 illustrates swing positions.

FIG. 3 shows positions of the golf player swinging the golf club 34. The position of FIG. 3(*a*) is an address. The position of FIG. 3(*b*) is a top-of-swing (hereinafter, referred to as a top). The position of FIG. 3(*d*) is an impact. The impact is a position of the moment of collision of the head 34*a* and the golf ball 36. The position of FIG. 3(*c*) is a downswing leading to the impact from the top. The position of FIG. 3(*e*) is a finish. The swing of the golf player continuously shifts to the top from the address, to the impact through the downswing from the top, and to the finish from the impact. The swing is ended in the finish.

The example of use of the swing analysis apparatus 10 of FIG. 1 will be described. In the example of use, a tape 38 as an elongated mark is stuck on a crown of the head 34*a* of the golf club 34. The tape 38 is stuck on the crown along the edge of the face surface of the golf club 34. A plurality of points 40 as marks is applied also to the golf ball 36. The golf ball 36 is set on the tee 18. The golf player addresses the ball with the golf club 34.

The golf player starts to swing the golf club 34. The first sensor 24 detects the golf club 34 in the process of the downswing leading to the impact. A detection signal of the first sensor 24 is output to the controller 30. The controller 30 outputs a light emitting start signal to the strobe light 28*a* at a time T1 after receiving the detection signal. The strobe light 28*a* emits light. The controller 30 outputs a photographing start signal to the club camera 20 at a time T2 (T2>T1) after receiving the detection signal.

Then, the second sensor 26 detects the golf club 34. A detection signal of the second sensor 26 is output to the controller 30. The controller 30 outputs a light emitting start signal to the strobe light 28*b* at a time T3 after receiving the detection signal. The strobe light 28*b* emits light. The controller 30 outputs a photographing start signal to the club camera 20 at a time T4 (T4>T3) after receiving the detection signal.

The club camera 20 photographs the behavior of the golf club 34. A time period between the time T1 and the time T4, which is extremely short, is several hundreds of microseconds to several thousands of microseconds. The club camera 20 includes a multishutter. The club camera 20 enables high-speed continuous photographing at a predetermined time interval in one photographing area. At least two or more image signals are obtained by the continuous photographing. In the example, a first club image signal resulted from the photographing start signal of the first sensor and a second club image signal resulted from the photographing start signal of the second sensor are obtained. These image signals are output to the controller 30. The controller 30 converts the first club image signal to first club image data, and converts the second club image signal to second club image data.

In the analysis apparatus 10, time data of a photographing time in one time axis is applied to the club image data on the basis of detection times of the first sensor 24 and second sensor 26. For example, the time T2 is applied to the first club image data. The time T4 (T4>T2) is applied to the second club image data.

In the analysis apparatus 10, a distance between a detection position of the first sensor 24 and a detection position of the second sensor 26 is predetermined. A head speed Vh of the head 34*a* is calculated from the detection times of the first sensor 24 and second sensor 26, and the distance. The controller 30 determines times T5, T6, T7, and T8 from the head speed Vh, the detection position of the first sensor 24 or the detection position of the second sensor 26, and the position of the golf ball 36.

The controller 30 outputs a light emitting signal to the strobe light 29*a* at the time T5. The controller 30 outputs a photographing start signal to the ball camera 22 at the time T6. The controller 30 outputs a light emitting signal to the strobe light 29b at the time T7, and outputs a photographing start signal to the ball camera 22 at the time T8. A time period between the time T5 and the time T8, which is also extremely short, is several hundreds of microseconds to several thousands of microseconds.

The ball camera 22 photographs the behavior of the golf ball 36. The ball camera 22 includes a multishutter. The ball camera 22 performs high-speed continuous photographing at a predetermined time interval. A plurality of instantaneous image signals is obtained by the continuous photographing. In the example, a first ball image signal and a second ball image signal are obtained. These image signals are output to the controller 30. The controller 30 converts the first ball image signal and the second ball image signal to first ball image data and second ball image data respectively.

The time T6 is applied to the first ball image data. The time T8 is applied to the second ball image data. Thus, the time data representing the photographing time in one time axis is applied to the image data. Herein, the application of the time data of the one time axis is defined as synchronization. The image data is synchronized with the one time axis. The ball image data is synchronized. Furthermore, the time axis of the time data of the ball image data is the same as that of the time data of the club image data, and the ball image data is synchronized with the club image data.

The controller 30 outputs the time data, the club image data, and the ball image data to the information processor 32.

The information processor 32 calculates a predetermined behavior value of the club from the club image data. Herein, for example, a value of a face angle, a value of a head orbital angle, and a value of a lateral hitting point are calculated.

Figure 4:
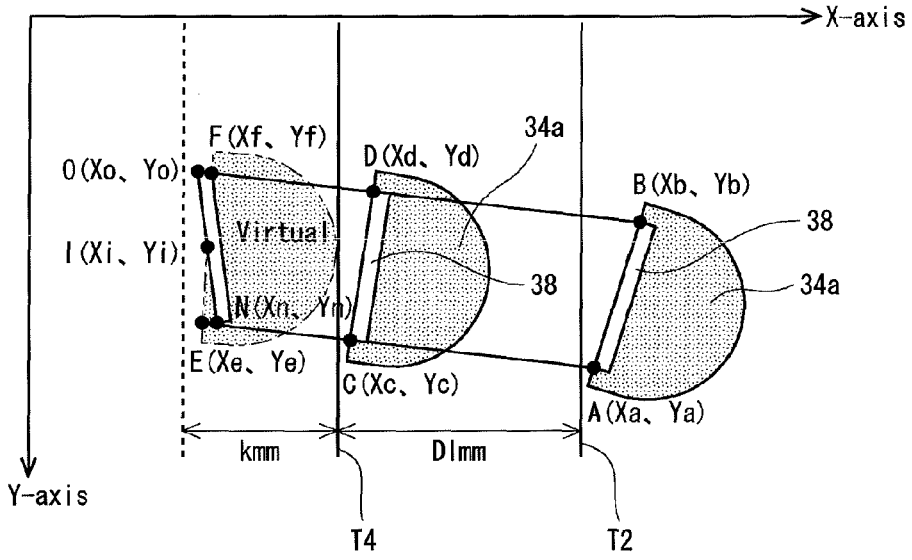
FIG. 4 illustrates a method for measuring a face angle using the analysis apparatus of FIG. 1.

A method for calculating the value of the face angle from the club image data is exemplified with reference to FIG. 4. An X-axis, which is a front-back direction (a golf player's lateral direction), is a flight direction of the golf ball 36. AY-axis, which is a lateral direction (a golf player's front-back direction), is an axis orthogonal to the X-axis in the level surface. A point A (Xa, Ya) shows a position of one end point of the tape 38. A point B (Xb, Yb) shows a position of the other end point of the tape 38. Herein, both the point A and the point B are corner points of the tape 38 close to the face surface. The point A (Xa, Ya) and the point B (Xb, Yb) are calculated from the club image data of the time T2.

A calculation face angle θr1 is calculated by the following formula from the point A (Xa, Ya) and the point B (Xb, Yb).

$$\theta r1=\arctan((Xb-Xa)/(Ya-Yb))\cdot 180/\pi$$

The calculation face angle θr1 is calculated based on the image data photographed by the club camera 20 photographing the club diagonally from the upper side. A correction face angle θm1 is calculated by the following formula based on the calculation face angle θr1.

$$\theta m1=A\cdot\theta r1+B$$

A coefficient A is a correction coefficient based on the position of the club camera 20. A segment B is a correction segment based on the position of the club camera 20. The coefficient A and the segment B, which are previously calculated from a deviation between an actually measured face angle of the head 34*a* and the calculation face angle obtained from the club camera 20, are applied to the information processor 32. For example, the coefficient A and the segment B are determined from the relationship between the actually measured face angle and the calculation face angle, of a position detected by the first sensor 24 and a position detected by the second sensor 26. The coefficient A and the segment B may be determined from the relationship between the actually measured face angle and calculation face angle of any one of the position detected by the first sensor 24 and the position detected by the second sensor 26.

A point C (Xc, Yc) of FIG. 4 shows a position of one end point of the tape 38 of the time T4. Similarly, a point D (Xd, Yd) shows a position of the other end point of the tape 38 of the time T4. A correction face angle θm2 of the time T4 is obtained as follows, as in the correction face angle θm1.

$$\theta r2=\arctan((Xd-Xc)/(Yc-Yd))\cdot 180/\pi$$

$$\theta m2=A\cdot\theta r2+B$$

Next, a virtual position of the head 34*a* at a position (a position of a time immediately before hitting) where the head 34*a* of the golf club 34 is brought into contact with the golf ball 36 is calculated. A point E (Xe, Ye) of FIG. 4 shows a position of a primary virtual point of one end of the tape 38 at the time immediately before hitting. Similarly, a point F (Xf, Yf) shows a position of a primary virtual point of the other end of the tape 38 at the time immediately before hitting.

As shown in FIG. 4, herein, a distance between the position of the time T2 and the position of the time T4 is defined as D1 mm. A distance between the position of the time T4 and the position of the time immediately before hitting is defined as k mm. The point E (Xe, Ye) and the point F (Xf, Yf) are calculated by the following formulae.

$$Xe=Xc+(Xc-Xa)\cdot k/D1,\ Ye=Yc+(Yc-Ya)\cdot k/D1$$

$$Xf=Xd+(Xd-Xb)\cdot k/D1,\ Yf=Yd+(Yd-Yb)\cdot k/D1$$

A point T (Xi, Yi) of FIG. 4 shows a midpoint between the point E (Xe, Ye) and the point F (Xf, Yf). The midpoint I (Xi, Yi) is obtained by the following formula from the point E (Xe, Ye) and point F (Xf, Yf) of the primary virtual position.

$$Xi=(Xe+Xf)/2,\ Yi=(Ye+Yf)/2$$

A point N (Xn, Yn) and point O (Xo, Yo) of FIG. 4 show a secondary virtual position. The secondary virtual position is obtained by subjecting the head 34*a* existing at the primary virtual position to rotation correction on an XY plane. The rotation correction corrects a rotating amount of the head 34*a* between the detection position of the time T4 and the primary virtual position. A value α of the rotation correction is calculated, for example, based on the point A (Xa, Ya) and the point B (Xb, Yb), and the point C (Xc, Yc) and the point D (Xd, Yd).

The point N (Xn, Yn) and the point O (Xo, Yo) are calculated by the following formulae.

$$Xe'=Xe-Xi,\ Ye'=Ye-Yi$$

$$Xf'=Xf-Xi,\ Yf'=Yf-Yi$$

$$Xn'=Xe'\cdot\cos(\alpha)-Ye'\cdot\sin(\alpha)$$

$$Yn'=Xe'\cdot\sin(\alpha)+Ye'\cdot\cos(\alpha)$$

$$Xo'=Xf'\cdot\cos(\alpha)-Yf'\cdot\sin(\alpha)$$

$$Yo'=Xf'\cdot\sin(\alpha)+Yf'\cdot\cos(\alpha)$$

$$Xn=Xn'+Xi,\ Yn=Yn'+Yi$$

$$Xo=Xo'+Xi,\ Yo=Yo'+Yi$$

A calculation face angle θr3 and a correction face angle θm3 at The position immediately before hitting are calculated from the point N (Xn, Yn) and point O (Xo, Yo) of the secondary virtual position.

$$\theta r3=\text{arc}\tan((Xo-Xn)/(Yn-Yo))\cdot 180/\pi$$

$$\theta m3=A^{SM}\theta r3+B$$

Figure 5:
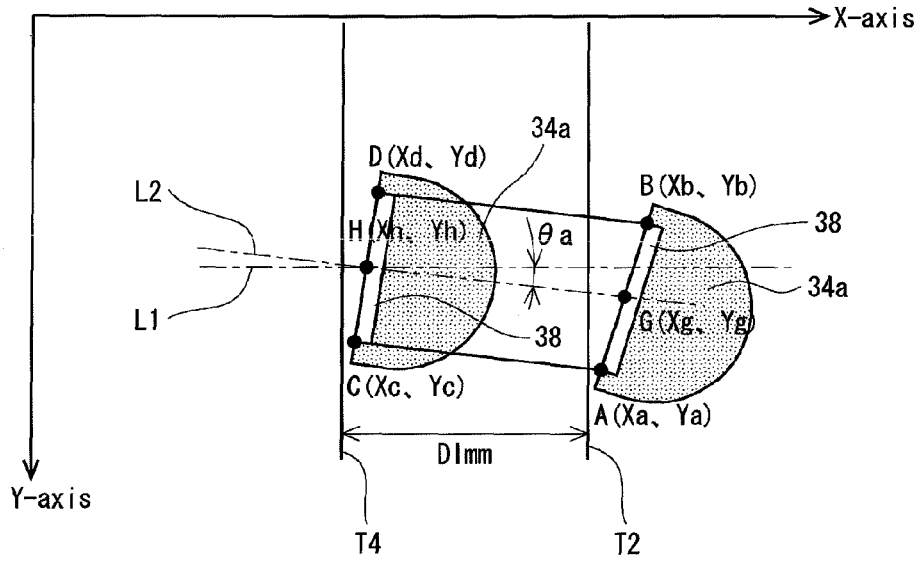
FIG. 5 illustrates a method for measuring a head orbital angle using the analysis apparatus of FIG. 1.

A method for calculating the value of the head orbital angle is exemplified with reference to FIG. 5. A double-headed arrow θa shows the value of the head orbital angle. A point G (Xg, Yg) of FIG. 5 shows a midpoint between the point A (Xa, Ya) and the point B (Xb, Yb). A point H (Xh, Yh) shows a midpoint between the point C (Xc, Yc) and the point D (Xd, Yd). The midpoint G (Xg, Yg) and the midpoint H (Xh, Yh) are obtained by the following formulae.

$$Xg=(Xa+Xb)/2,\ Yg=(Ya+Yb)/2$$

$$Xh=(Xc+Xd)/2,\ Yh=(Yc+Yd)/2$$

A one-dotted chain line L1 is a straight line parallel to the X-axis. A one-dotted chain line L2 is a straight line passing through the midpoint G (Xg, Yg) and the midpoint H (Xh, Yh). The head orbital angle θa is obtained as a crossing angle between the one-dotted chain line L1 and the one-dotted chain line L2.

Figure 6:
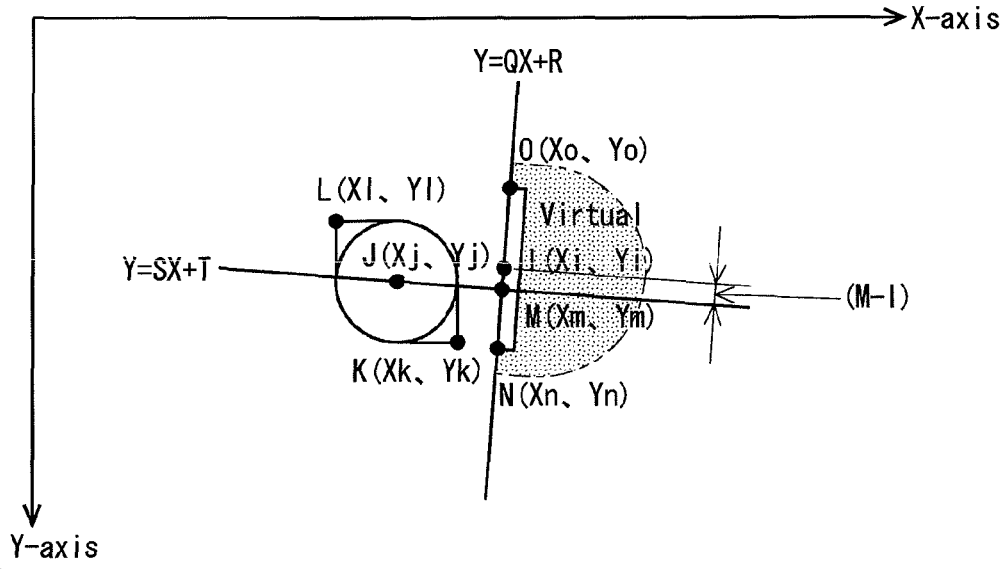
FIG. 6 illustrates a method for measuring a lateral hitting point using the analysis apparatus of FIG. 1.

A method for calculating the value of the lateral hitting point is exemplified with reference to FIG. 6. A straight line Y=Q·X+R of FIG. 6 is a straight line passing through the point N (Xn, Yn) and point O (Xo, Yo) of the secondary virtual position. A coefficient Q and segment R of the straight line are obtained by the following formulae.

$$Q=(Yn-Yo)/(Xo-Xn)$$

$$R=Yn-Q\cdot Xn$$

A point J (Xj, Yj) of FIG. 6 shows a center position of the golf ball 36. Each of a point K (Xk, Yk) and a point L (Xl, Yl) is an intersecting point of a tangent line of the golf ball 36 parallel to the X-axis and a tangent line thereof parallel to the Y-axis. The point K (Xk, Yk) and the point L (Xl, Yl) are positioned in symmetry with respect to the point J (Xj, Yj). The point J (Xj, Yj) is obtained by the following formula from the point K (Xk, Yk) and the point L (Xl, Yl).

$$Xj=(Xk+Xl)/2,\ Y=(Yk+Yl)/2$$

A coefficient S and segment T of a straight line Y=S·X+T of FIG. 6 are obtained by the following formulae.

$$S=-1/Q$$

$$T=Yj-S\cdot Xj$$

A point M (Xm, Ym) of FIG. 6 shows a position of the lateral hitting point. The point M (Xm, Ym) is an intersecting point of the straight line Y=Q·X+R and straight line Y=S·X+T. The point M (Xm, Ym) is obtained by the following formulae.

$$Xm=(T-R)/(Q-S)$$

$$Ym=Q\cdot Xm+R$$

A double-headed arrow (M-I) of FIG. 6 shows the value of the lateral hitting point. The lateral hitting point (M-I) is obtained by the following formula.

$$(M-I)=((Xi-Xm)^2+(Yi-Ym)^2)^{1/2}$$

When Ym−Yi is positive, (M−I) is represented by a positive number. When Ym−Yi is negative, (M−I) is represented by a negative number.

The information processor 32 calculates a predetermined behavior value of the ball from the ball image data. Herein, for example, a value of a ball speed, a value of a launch angle, a value of a deflection angle, a value of backspin, and a value of sidespin are calculated. These values are calculated based on the ball image data obtained from the ball camera 22. For example, the values are calculated from the first ball image data of the time T6 and the second ball image data of the time T8.

The ball speed is calculated from the position of the golf ball 36 obtained from the first ball image data and the second ball image data, the time T6, and the time T8.

The launch angle represents an angle of a direction where the golf ball 36 is launched in the vertical direction with the horizontal direction set to 0 degree. The deflection angle represents an angle of the lateral direction (the golf player's front-back direction) where the golf ball 36 is launched, in the level surface (XY plane). An X-axis direction of a direction where the golf ball 36 is launched straight is set to 0 degree, and the deflection angle is obtained. For example, a distance between the ball and the ball camera 22 is obtained from the size of the ball obtained from the first ball image data and the second ball image data. The deflection angle is obtained from the distance.

The backspin is an amount of rotation in the front-back direction of the golf ball 36. The sidespin is an amount of rotation in the lateral direction of the golf ball 36. The backspin and the sidespin are obtained from the ball image data of the above-mentioned two positions. The backspin and the sidespin may be obtained from the ball image data of three positions obtained by further adding one position.

The calculated club behavior value and ball behavior value are stored with the time data in the information processor 32. The information processor 32 displays a predetermined behavior value on the monitor from the club behavior value and ball behavior value.

In the analysis apparatus 10, the ball behavior value is stored so as to correspond to the club behavior value. When the value of the ball speed, the value of the launch angle, the value of the deflection angle, the value of backspin, and the value of sidespin are specified, the flight distance and flight direction of the golf ball 36 can be calculated. In the analysis apparatus 10, the flight distance and flight direction of the golf ball 36 corresponding to the club behavior value such as the face angle, the head orbital angle, and the lateral hitting point position can be calculated.

In the analysis apparatus 10, the installation position of the club camera 20 in the lateral direction (the golf player's front-back direction) is a position separated by 0.1 m or greater and 0.7 m or less from the position of the tee 18 in a direction away from the golf player. The installation position of the club camera 20 in the front-back direction (the golf player's lateral direction) is in a range of 0 m forward and 0.5 m backward from the position of the tee 18. In the present invention, the range of the installation position of the club camera 20 in the front-back direction is the forward range of the golf player.

The club camera 20 is installed at a predetermined height in front of the golf player. When the golf player swings, the breakage of the club camera 20 is prevented. An image similar to an image photographed from right above can be photographed. In this respect, the height Hc is preferably equal to or greater than 1 m, and more preferably equal to or greater than 1.1 m. On the other hand, when the club camera 20 is brought to a high position, the support rod 14 is heightened. In respect of carrying about the analysis apparatus 10, the height Hc is preferably equal to or less than 2.5 m, more preferably equal to or less than 2 m, and particularly preferably equal to or less than 1.5 m.

The club camera 20 photographs the club from a direction of a predetermined angle θc in front of the golf player. An image similar to an image of a camera photographing from right above the golf ball 36 is obtained. In this respect, the angle θc is preferably equal to or less than 20 degrees, and more preferably equal to or less than 18 degrees. On the other hand, in order to photograph the club from a position close to right above the golf ball 36 without disturbing the swing, it is necessary to highly set the support rod 14. This enlarges the apparatus. In this respect, the angle θc is preferably equal to or greater than 10 degrees, and more preferably equal to or greater than 12 degrees.

In the analysis apparatus 10, the club behavior value corrected from the club behavior value calculated from the club image data is obtained. Accordingly, the club behavior value more similar to the image data photographed from right above is obtained. In the image obtained by photographing the club from right above the golf ball 36, the value of the face angle, the value of the head orbital angle, and the value of the lateral hitting point can be more accurately obtained. Accordingly, in the analysis apparatus 10, the club behavior value is accurately obtained.

The tape 38 is stuck with the longitudinal direction thereof along the face surface. The face side corners of both the ends of the tape 38 are set to position measurement points. Accordingly, the club behavior value of the head 34*a* can be accurately calculated by sticking one tape 38. Although the tape 38 is used herein, the tape 38 may not be used. Point marks maybe respectively applied to these position measurement points. The club behavior value can be similarly obtained by recognizing the position of a discriminable optional point such as the edge of the head 34*a* without particularly using the marks.

The plurality of points 40 is applied to the surface of the golf ball 36. The value of the backspin and the value of the sidespin can be more accurately calculated by recognizing two points 40 of the plurality of points 40. Although the points 40 are applied herein, the points 40 may not be applied. Designs such as brands and numbers are usually applied to the golf ball 36. The value of the backspin and the value of the sidespin can be obtained by recognizing the designs.

In the analysis apparatus 10, the photographing times T6 and T8 of the ball camera 22 are determined based on the head speed Vh of the golf club 34. Accordingly, suitable ball image data can be easily obtained.

The club camera 20 performs continuous photographing using the high-speed shutter at a short time interval. At least the continuously photographed first club image data of the time T2 and second club image data of the time T4 are obtained in the photographing area of the club camera 20. The positional relationship of the moving golf club 34 can be accurately measured by obtaining two club image data in one photographing area. For example, when the club image data photographed by two different cameras are used, the disposal setting error of the two cameras influences the calculation error of the club behavior value. In the analysis apparatus 10, the relative positional accuracy between the club camera 20 and the other camera is not required when the club camera 20 is installed. Continuously photographed third club image data and fourth club image data or the like may be further used by the club camera 20.

The ball camera 22 also performs continuous photographing using the high-speed shutter as in the club camera 20. The continuously photographed first ball image data and second ball image data are obtained. The two ball image data are obtained in one photographing area. The ball camera 22 is also installed easily. The analysis apparatus 10 is installed easily. Continuously photographed third ball image data and fourth ball image data or the like may be further used.

In the analysis apparatus 10, the club behavior value immediately before hitting is calculated from the first club behavior value obtained from the first club image data and the second club behavior value obtained from the second club image data. The club behavior value immediately before hitting can be accurately calculated by using the continuously photographed image data. The analysis result of the golf club 34 can be intelligibly provided to the golf player by calculating the club behavior value immediately before hitting. In the analysis apparatus 10, a more intelligible analysis result can be provided by providing the behavior value of the golf club 34 and the behavior value of the golf ball 36, with the flight distance and flight direction of the golf ball 36.

Since the tee 18, the club camera 20, and the ball camera 22 are relatively positioned and mounted in the analysis apparatus 10, the devices are installed easily. The analysis apparatus 10 is sufficiently prepared by sticking the tape 38 on the golf club and applying the points to the ball. In the analysis apparatus 10, the golf player's measurement preparation and the measurement analysis of the swing can be performed within a relatively short time.

The analysis apparatus 10 can be used as a golf club fitting apparatus by adding a function for determining and outputting a fitting golf club from a plurality of stored candidate golf clubs, to the information processor 32 of the analysis apparatus 10. Fitting is performed based on the above-mentioned club behavior value and ball behavior value. The fitted golf club can be output to the monitor or the like, with data such as the club behavior value, the ball behavior value, and the flight distance and flight direction of the golf ball 36.

When the fitting of the golf club is performed based on the club behavior value and the ball behavior value, most suitable fitting can be performed in respect of the flight distance or flight direction of the golf ball 36. The fitting apparatus can be carried about as in the analysis apparatus 10, and has a simple constitution. The fitting apparatus enables the fitting of the golf club in various places including outdoors. The fitting apparatus can be installed within a relatively short time, and can perform the fitting of the golf club.

Particularly, the value of the face angle among the club behavior values has a strong correlation with the flight distance and flight direction of the golf ball 36. In the analysis apparatus 10, the value of the face angle is obtained from the image data similar to the image photographed from right above. The value of the face angle can be simply and accurately measured by using the fitting apparatus. The fitting apparatus can perform fitting more effective to the flight distance and the flight direction of the golf ball 36.

The description hereinabove is merely for an illustrative example, and various modifications can be made in the scope not to depart from the principles of the present invention.

What is claimed is:

1. A swing analysis apparatus comprising:

a club camera continuously photographing a behavior of a golf club;

a ball camera continuously photographing a behavior of a golf ball; and an information processor, wherein the club camera is positioned in front of a golf player swinging the golf club, and an angle θc between a straight line C and a vertical line Z passing through a center of the golf ball is 10 degrees or greater and 20 degrees or less, the straight line C passing through a center of a lens of the club camera and the center of the golf ball;

two or more club image data continuously photographed by the club camera are synchronized;

two or more ball image data continuously photographed by the ball camera are synchronized;

the information processor measures a synchronized club behavior value from the synchronized club image data, and measures a synchronized ball behavior value from the synchronized ball image data;

the number of the club camera is one; and the photographing by the club camera is performed from a single direction of the angle θc.

2. The analysis apparatus according to claim 1, further comprising a sensor detecting the golf club existing at a predetermined position during a downswing, wherein photographing start times of the club camera and ball camera are determined based on a detection signal of the golf club output by the sensor.

3. The analysis apparatus according to claim 2, wherein the sensor comprises a first sensor and a second sensor; and a head speed of the golf club is measured based on a detection signal of the golf club output by the first sensor and a detection signal of the golf club output by the second sensor.

4. The analysis apparatus according to claim 1, wherein the club camera is disposed at a position where a height from a ground level is equal to or greater than 1 m and equal to or less than 2.5 m.

5. The analysis apparatus according to claim 1, wherein the club behavior value is a value of a face angle, a value of a head orbital angle, and a value of a lateral hitting point.

6. The analysis apparatus according to claim 1, wherein the ball behavior value is a value of a ball speed, a value of a launch angle, a value of a deflection angle, a value of backspin, and a value of sidespin.

7. The analysis apparatus according to claim 1, further comprising an elongated mark, wherein the elongated mark is stuck on a crown of the golf club; and positions of both ends of the elongated mark are measured to measure the club behavior value.

8. The analysis apparatus according to claim 1, wherein a plurality of marks is put on the golf ball; and positions of two marks of the plurality of marks are measured to measure the ball behavior value.

9. The analysis apparatus according to claim 1, wherein the club camera continuously photographs the golf club during a swing to obtain first club image data and second club image data; and a club behavior value immediately before hitting is calculated from a first club behavior value measured from the first club image data and a second club behavior value measured from the second club image data.

10. The analysis apparatus according to claim 1, further comprising a strobe light which emits light accompanied with the continuously photographing by the club camera, and a support rod extending upward, wherein the club camera is positioned and mounted to an upper part of the support rod, and the strobe light is disposed below the club camera and is mounted to the support rod.

11. The analysis apparatus according to claim 1, wherein two or more club image data are obtained in one photographing area of the club camera.

12. A golf club fitting apparatus comprising:

a club camera continuously photographing a behavior of a golf club;

a ball camera continuously photographing a behavior of a golf ball; and an information processor, wherein the club camera is positioned in front of a golf player swinging the golf club, and an angle θc between a straight line C and a vertical line Z passing through a center of the golf ball is 10 degrees or greater and 20 degrees or less, the straight line C passing through a center of a lens of the club camera and the center of the golf ball;

two or more club image data continuously photographed by the club camera are synchronized;

two or more ball image data continuously photographed by the ball camera are synchronized;

the information processor measures a synchronized club behavior value from the synchronized club image data, measures a synchronized ball behavior value from the synchronized ball image data, stores the synchronized club behavior value and the synchronized ball behavior value, and determines a fitting golf club from a plurality of candidate golf clubs based on the club behavior value and the ball behavior value;

the number of the club camera is one; and the photographing by the club camera is performed from a single direction of the angle θc.

13. The fitting apparatus according to claim 12, wherein the club behavior value is a face angle.

14. A swing analysis apparatus comprising:

a single club camera with a single lens continuously photographing a behavior of a golf club;

a ball camera continuously photographing a behavior of a golf ball; and an information processor, wherein the single club camera is positioned in front of a golf player swinging the golf club, and an angle θc between a straight line C and a vertical line Z passing through a center of the golf ball is 10 degrees or greater and 20 degrees or less, the straight line C passing through a center of a lens of the single club camera and the center of the golf ball;

two or more club image data continuously photographed by the single club camera are synchronized;

two or more ball image data continuously photographed by the ball camera are synchronized;

the information processor measures a synchronized club behavior value from the synchronized club image data, and measures a synchronized ball behavior value from the synchronized ball image data;

the number of the single club camera is one; and the photographing by the single club camera is performed from a single direction of the angle θc.

* * * * *